US006467631B2

(12) United States Patent
Strangalies et al.

(10) Patent No.: US 6,467,631 B2
(45) Date of Patent: Oct. 22, 2002

(54) AIR SIFTING APPARATUS

(75) Inventors: Walter Strangalies, Altenholz; Walter Jungmann, Essen, both of (DE); Richard J. Snoby, Alpharetta, GA (US)

(73) Assignee: allmineral LLC, Alpharetta, GA (US)

( * ) Notice: Subject to any disclaimer, the term of this patent is extended or adjusted under 35 U.S.C. 154(b) by 0 days.

(21) Appl. No.: 09/775,758

(22) Filed: Feb. 1, 2001

(65) Prior Publication Data

US 2002/0100713 A1 Aug. 1, 2002

(51) Int. Cl.[7] ..... B07B 4/00

(52) U.S. Cl. ..... 209/474; 209/475; 209/489; 209/491; 209/499

(58) Field of Search ..... 209/474, 475, 209/488, 489, 490, 491, 493, 497, 498, 499, 502

(56) References Cited

U.S. PATENT DOCUMENTS

| | | | | | |
|---|---|---|---|---|---|
| 2,512,422 | A | * | 6/1950 | Fletcher et al. | 209/475 |
| 3,007,577 | A | * | 11/1961 | Putman | 209/475 |
| 3,472,379 | A | * | 10/1969 | Lainas et al. | 209/493 X |
| 3,539,001 | A | * | 11/1970 | Binnix et al. | 209/475 |
| 3,852,168 | A | * | 12/1974 | Oetiker | 209/467 X |
| 5,244,099 | A | * | 9/1993 | Zaltzman et al. | 209/493 X |

FOREIGN PATENT DOCUMENTS

| | | | | |
|---|---|---|---|---|
| SU | 1033235 | * | 8/1983 | 209/474 |

OTHER PUBLICATIONS

Article "Aufbereitung fester mineralischer Rohstoffe".

* cited by examiner

*Primary Examiner*—Tuan N. Nguyen
(74) *Attorney, Agent, or Firm*—R W Becker & Associates; R W Becker

(57) ABSTRACT

An air sifting apparatus is provided for preparatory concentration of raw material including coal, and includes a material feed-in device, a material bed support device, an air jig plenum, and a discharge control device. The material bed support device receives material from the material feed-in device and has a surface having a plurality of openings for a gaseous medium introduced from underneath the material bed support device, which is operable to transport material in coordination with the flow of gaseous medium through the openings to effect loosening and stratification of the material into a layer of relatively heavier material, and a layer of relatively lighter material on the heavier material. The air jig plenum communicates with the underside of the apparatus for guiding gaseous medium thereto and produces constant air flow through the openings of the support device and a pulsating air flow, overlaid on the constant air flow, for pulse impacting material on the support device. The discharge control device controls discharge of material from the support device such that relatively lighter material is directed to one location and relatively heavier material is directed to another location.

26 Claims, 4 Drawing Sheets

AIR SIFTING APPARATUS

BACKGROUND OF THE INVENTION

The present invention relates to an air sifting or settling apparatus for preparatory concentration of raw materials including, in particular, coal.

Known air sifting apparatus comprise a material feed device, a material bed support device with holes through which flows air guided by an air plenum disposed underneath the material bed support device, the inflowing air operating to loosen the material which has been fed onto the material bed support device in a manner by which the material on the material bed support device is stratified into layers of relatively lighter material on top of layers of relatively heavier material, and a usual discharge control device for controlling the separated discharge of the relatively lighter material and the relatively heavier material. An air sifting apparatus of this type is described, for example, in the publication Schubert "Aufbereitung fester mineralischer Rohstoffe", Band II VEB Deutscher Verlag fuer Grundstoffindustrie, Leipzig, Pages 89 and 90.

In considering the known air sifting apparatus, it has typically been viewed as a disadvantage that, in comparison with wet sifting machines having the same operating principle, only a small separation distinction exists between the heavier material and the lighter material. In this regard, a satisfactory sorting result can be expected only if the density difference between the components of the material to be separated is sufficiently large and if the material is narrowly classified within a relatively narrow size range—that is, if it lies within a narrowly defined kernel or grain size range. Moreover, the top surface of the material must be low in surface moisture since otherwise capillary retention forces hinder the relative movement of the kernels or grains. A further problem with such known air sifting apparatus is that the pressure drop differs relatively greatly as the material being transported on the material bed support device is subjected to the through flow of the air and pulsating movement. Thus, the area of the material feed-in end of the material bed support device, with a large layer thickness, is characterized by a greater pressure drop than the area at the outlet end of the material bed support device at which a stratification of the material bed has already been effected.

The aforementioned Schubert publication describes, as a solution to this drawback, a Soviet air sifting apparatus construction in which a packing of ceramic balls are located underneath the material bed support device, with the thickness of the packing being varied in correspondence with the anticipated resistance of the bed of the material bed support device so that the pressure drop of the ball packing and the comprehensive portion of the bed of the material bed support device can be influenced. A generally uniform pressure drop can be introduced by this approach along the length of the material bed support device.

SUMMARY OF THE INVENTION

The present invention provides an air sifting apparatus which offers a solution to the challenge of providing an air sifting apparatus in which a uniform pressure drop can be instituted without excessive effort across the surface of the material bed support device, whereby a good separation result in view of the material to be separated can be achieved.

The solution to this challenge is principally comprised of providing an air jig hutch or plenum for transmitting two air flows which are delivered to the air sifting apparatus and which flow through the bed thereof, wherein one of the air flows constantly flows through the material bed support device and the other air flow flows in a pulsing manner overlaid on the constant air flow. A base fluidization of the material to be prepared and disposed on the material bed support device is provided by the impact thereagainst of the constant air flow such that a certain loosening of the material is effected which is characterized by a reduced pressure loss due to the vertical through flow of the material bed support device by the air flow. In this manner, in view of the overlaid pulsating air flow, there is required only a significantly reduced volume of pulse air, as compared to conventional requirements, to effect periodic uplifting of the material disposed on the material bed support device so as to thereby accomplish a stratification of the material. The constant air flow can be adjusted such that material which has been disposed on the material bed support device is loosened but not yet uplifted, whereupon the pulsating air flow is adjusted to a pulse strength sufficient to lift the material upwardly and thereby effect stratification of the bed of material into relatively heavier material layers and relatively lighter material layers.

In accordance with embodiments of the air sifting apparatus of the present invention, the pressure of the pulsating air flow can be adjusted to be the same as or, alternatively, to be greater than, the pressure of the constant air flow.

It can further be provided, in accordance with the present invention, that the flow volume of the pulsating air flow can be adjusted to be smaller than the flow volume of the constant air flow.

In accordance with one variation of the air sifting apparatus of the present invention, two air flow generators are provided for the respective production of the constant air flow and the pulsating air flow, or a common air flow generator for the production of both the constant air flow and the pulsating air flow is provided, whereby the adjustment of the air flow at the air jig plenum is accomplished via a pressure regulator.

In accordance with an embodiment of the present invention, the material bed support device can be configured as a polyurethane screen deck, a plate with holes or as a wire screen, such as woven wire or profile wire in all configurations, whereby the material bed support device exhibits sufficient restriction for an even distribution of air flow yet is sufficiently open to allow a pass through capability for the passage therethrough of the constant air flow as well as for the passage therethrough of the constant air flow with the pulsating air flow overlaid thereon.

In accordance with an embodiment of the air sifting apparatus of the present invention, it is advantageous if the material feed-in device which feeds the material onto the material bed support device is configured such that there is provided a uniform volume of feed of the material to be prepared onto the material bed support device. By feeding or dosing the material onto the material bed support device in as uniform a unit volume as possible, an overfilling of the material bed support device is avoided; such overfillings would lead, in certain regions of the air sifting apparatus, to a breakdown of the fluidization effected by the constant air flow.

In accordance with an embodiment of the air sifting apparatus of the present invention, the material feed in device is configured as a star gate feeder. In view of the fact that a constant material feed in capability of the star gate feeder over a predetermined operational period of the air sifting apparatus can be ensured only if, in connection with the vanes which rotate within the fixed housing of the star gate feeder and are arranged in a star pattern to form pockets between adjacent vanes for dose feeding of the material onto the material bed support device, the wear of the vanes can be limited, the present invention proposes as well a novel configuration of the star gate feeder. In view of the fact that, in the realm of conventional star gate feeders, a star gate feeder is typically integrally formed as a single unit, it is a special feature of the present invention that the vanes are each formed of a rubber material whose hardness grade or durometer varies along the height of the vane, whereby the end of the vane which slides along the inner wall of the housing has a reduced hardness grade or durometer as compared to that of the end of the vane secured to the drive shaft. This feature advantageously ensures that, on the one hand, the radially outermost end of the vane which slides along the inner wall of the housing and forms a material receiving pocket with an adjacent vane is prevented, by virtue of its construction with the relatively lowest hardness grade or durometer of rubber material, from binding on the inner wall of the housing while, on the other hand, the other end of the vane, by virtue of its construction with the relatively highest hardness grade or durometer of rubber material, is secured in a sufficiently stable manner to the drive shaft of the star gate feeder and, additionally, cannot be easily broken when subjected to performance demands in question.

In accordance with the present invention, it is purposefully suggested that the vane comprise, over at least 5% of its total length as measured from its radially outermost end, the rubber material of the relatively lowest hardness grade or durometer and/or that the vane comprise, over at least 25% of its total length as measured from its drive shaft secured end, the rubber material of the relatively highest hardness grade or durometer. In this manner, it has been shown to be advantageous if the radially outermost end of the vane which slides along the inner wall of the housing is configured in a ball shape.

In addition to providing the important function of a good separation distinction between the components of the material subjected to the concentration process, the air sifting apparatus of the present invention also provides the important function of a good discharge control of the stratified material and, in particular, of the relatively heavier material thereof, in that the discharge of the stratified material from the material bed support device is performed in a manner which is automatic and avoids the undesired pressure drop which would otherwise be unfavorably promoted by stronger fluctuations of the relatively heavier material layer caused by too strong drawing off of the relatively heavier material from the material bed support device.

In accordance with an embodiment of the air sifting apparatus of the present invention, the discharge control device can comprise a mechanical or nuclear sensor for sensing the position of the higher density layers, whereby, in both sensor configurations, the sensors are configured with respect to the differing thickness of the relatively heavier material and the relatively lighter material. An alternative possibility is that the discharge control device can comprise an appropriate optical sensor for determining relatively higher density material from the lower density material by sensing the different colors of the relatively heavier material and the relatively lighter material.

In individual situations, in accordance with an embodiment of the air sifting apparatus of the present invention, the discharge control device for the relatively lighter material can be configured as a weir whose height is adjustably settable as a function of the strength or thickness of the relatively heavier material layer in its role as a sifting bed, whereby, in another embodiment of the air sifting apparatus of the present invention, the discharge control device is configured as a star gate feeder having an adjustable rate of rotation.

DETAILED DESCRIPTION OF THE PREFERRED EMBODIMENTS

Figure 1:
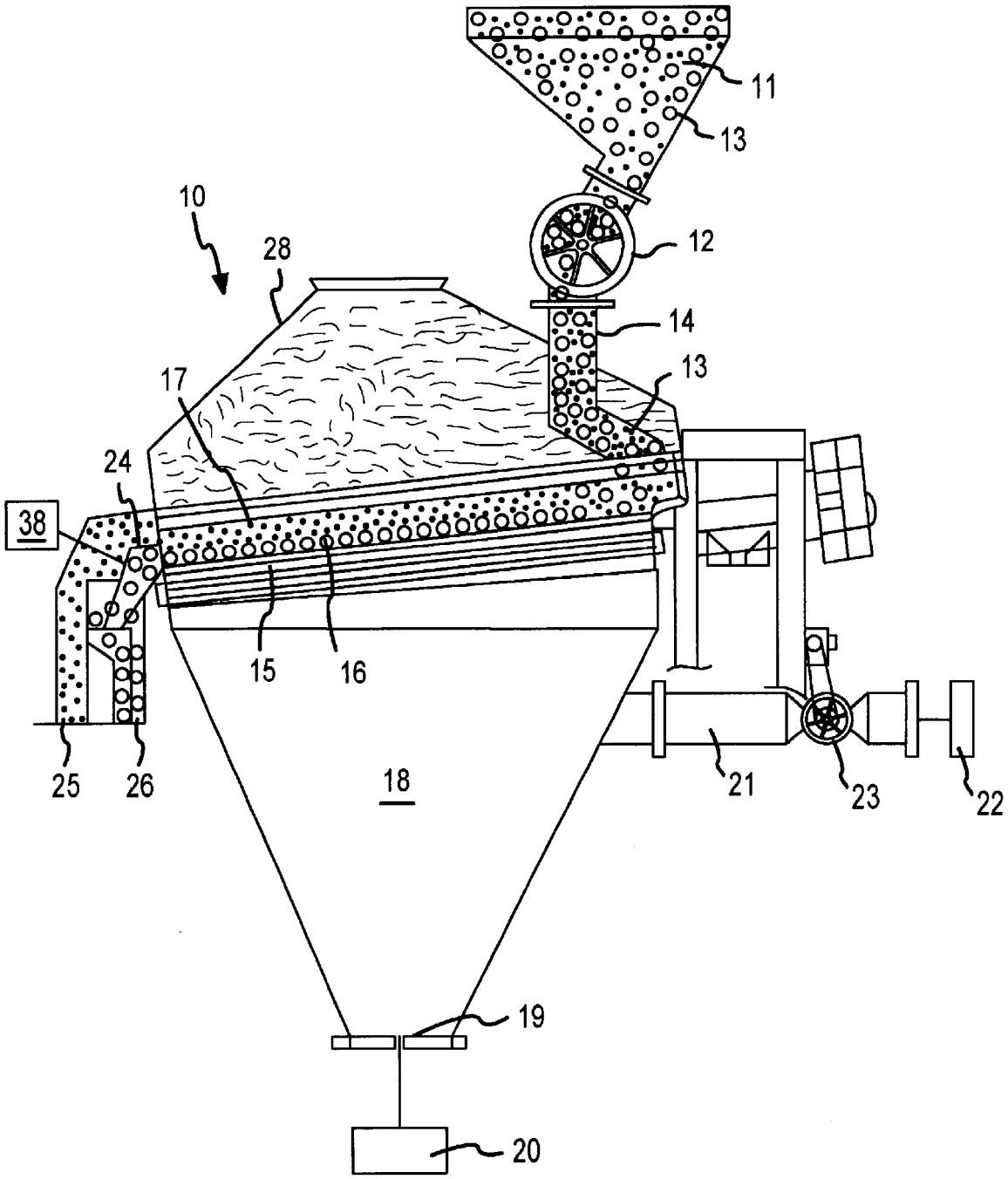
FIG. 1 is a schematic side view of one embodiment of the air sifting apparatus of the present invention having two air flow generators.

As seen in FIG. 1, an air sifting apparatus 10 of the present invention comprises a feed funnel or hopper 11 whose bottom outlet is communicated with a star gate feeder 12 such that a material 13, which is to be separated into a relatively lighter and a relatively heavier portion, is fed from the feed funnel 11 by the star gate feeder 12 into a feed chute 14. The lower end of the feed chute 14 is arranged in appropriate material feed relation with a material bed support device 15 mounted in the air sifting apparatus 10. The fed in material 13, due to the movement kinematics to be described hereinafter in more detail, is sorted in a stratification process, during its transport along the length of the material bed support device 15, into a relatively heavier material 16 and a relatively lighter material 17 that is distributed along the top of the relatively heavier material.

An air jig hutch or plenum 18 is disposed below the material bed support device 15 and is operable, in the performance of the stratification movement, to guide air supplied from below the material bed support device into contact with the material bed support device, which is configured as an air permeable metal or plastic plate with holes or as a wire screen. An air inlet 19 is provided at the bottom end of the air jig plenum 18 and a first air flow generator 20 is communicated with the air inlet. The first air flow generator 20 produces a constant air flow having a constant pressure and volume which enters the air jig plenum 18 via the air inlet 19 to be guided by the air jig plenum as a constant air flow against the underside of the material bed support device 15.

An additional air inlet 21 is disposed at the side of the material bed support device 15 and communicates a second volume of air into the plenum 18 from a second air flow generator 22 which delivers a pulsating air flow into the constant air flow being guided through the material bed support device 15, the pulsations in the air flow from the second air flow generator 22 being produced by a rotating valve 23.

The relative positions or locations of the constant air flow and of the pulsed air flow are not critical to the operation of this invention.

A discharge device 24 is disposed at the end of the transport path of the material bed support device 15 opposite to the feed end thereof which is adjacent the feed chute 14. The discharge device 24 is in the form of a weir operable to control the discharge, in a separating manner, of the relatively heavier material 16 and the relatively lighter material 17 from the material bed support device 15 such that the relatively heavier material 16 is guided into a front discharge chute 26 while the relatively lighter material 17 passes over the weir into a relatively lighter material discharge chute 25.

The air sifting apparatus 10 is closed off from the surrounding environment by a housing 28 which extends above the material bed support device 15 so that dust or debris which may arise in the course of the material concentrating process does not exit the air sifting apparatus. In this manner, the environmental burden of the air sifting apparatus is maintained at a correspondingly low level.

Figure 2:
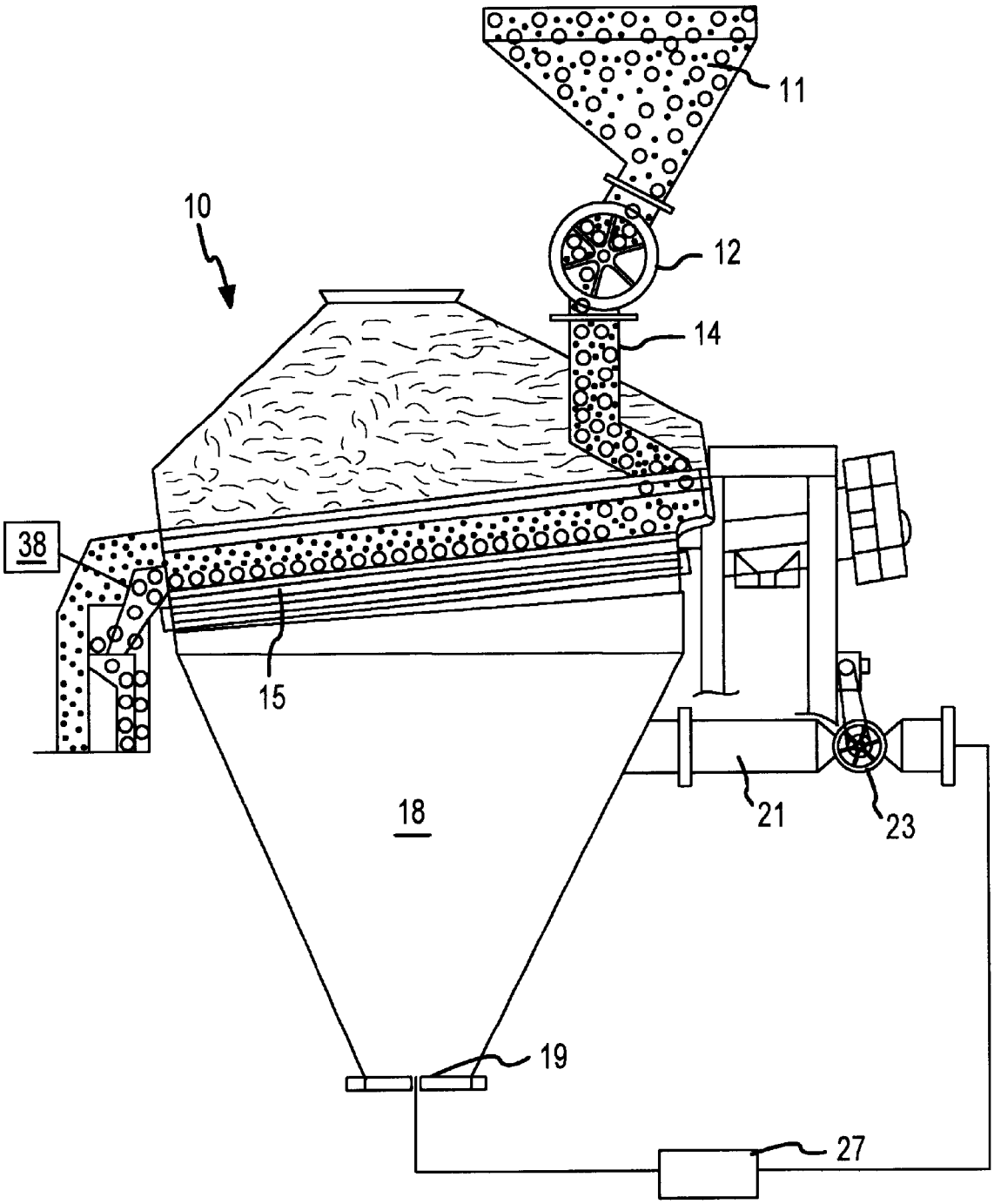
FIG. 2 is a schematic side view of another embodiment of the air sifting apparatus of the present invention having a single air flow generator.

The embodiment of the air sifting apparatus shown in FIG. 2 differs from the embodiment of the air sifting apparatus shown in FIG. 1 only insofar that the embodiment of the air sifting apparatus in FIG. 2 comprises a single air flow generator 27 for producing both the constant air flow introduced via the air inlet 19 into the air jig plenum 18, and the pulsating air flow introduced via the air inlet 21. The air flow generator 27 includes an integrated pressure regulator which provides the pressure, on the one hand, for the constant air flow and the same or different pressure, on the other hand, for the pulsating air flow.

Figure 3:
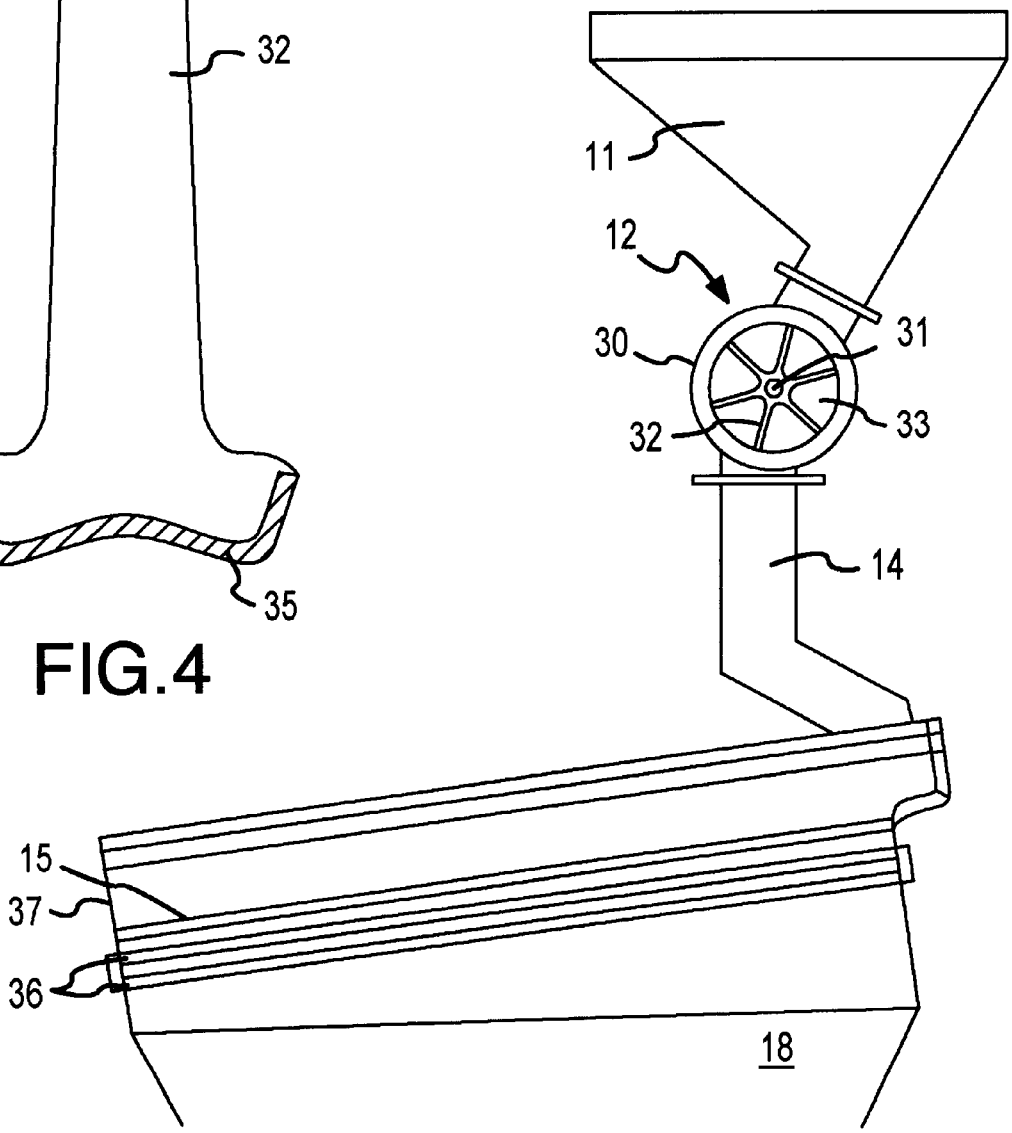
FIG. 3 is an enlarged schematic side view, in partial section, of the material feed-in portion of the air sifting apparatus shown in FIGS. 1 and 2.

The material bed support device 15 can be seen again in FIG. 3 in which is also illustrated the star gate feeder 12, which comprises a fixedly mounted housing 30, a drive shaft 31, and six vanes 32 connected to the drive shaft 31. The vanes 32 are driven radially by the drive shaft 31, with the radially outermost ends of the vanes in contact with the inner wall of the housing 30 such that pockets 33 are formed between adjacent pairs of the vanes 32 which receive the material 13 fed from the feed funnel 11 to thereafter feed the material 13 in a portion-wise manner to the feed chute 14. The star gate feeder 12 thus performs a uniform feeding or dosing function on the material being fed so that the material bed support device 15 constantly receives a uniform charge of fed material. As seen in FIG. 3, an elastomeric material 36 is used to connect the material bed support device 15 to the housing portion 37 which supports the material bed support device.

Figure 4:
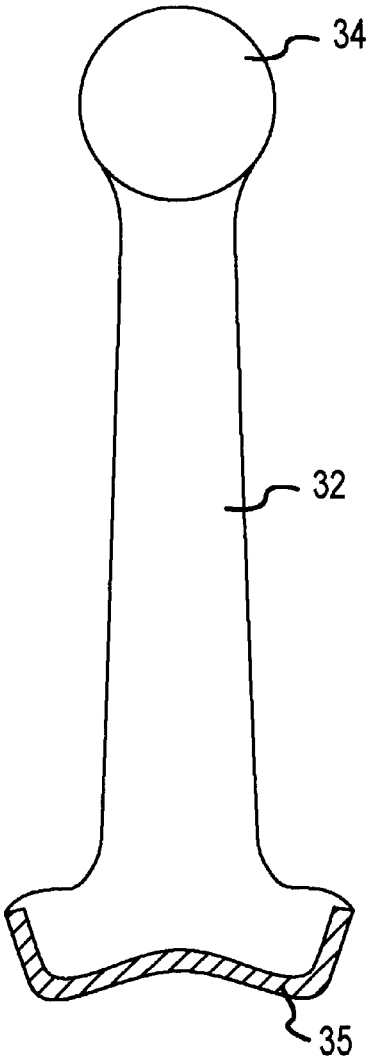
FIG. 4 is an enlarged view of a vane of the star gate feeder of the air sifting apparatus.

FIG. 4 shows the construction of a single vane 32 which has, on its drive shaft connecting end, a bracket 35 which is rigidly attached to the drive shaft. The radially outermost end 34 of the vane 32, which is opposite its drive shaft connecting end and which slides along the inner wall of the housing 30 of the star gate feeder 12 in its assembled condition, is ball shaped.

In accordance with the present invention, each vane 32 is comprised of a rubber material which has varying hardness grades or durometers over the height of the vane. In this manner, it can be provided that each vane 32 has, in the area of its ball shaped radially outermost end 34 and over at least 5% of its total length as measured from its radially outermost end, the rubber material of the relatively lowest hardness grade or durometer while having, at is drive shaft secured end with the bracket 35 and over at least 25% of its total height as measured from its drive shaft secured end, the rubber material of the relatively highest hardness grade or durometer. The hardness grades or durometer are between 35 and 80 Shore.

Figure 5:
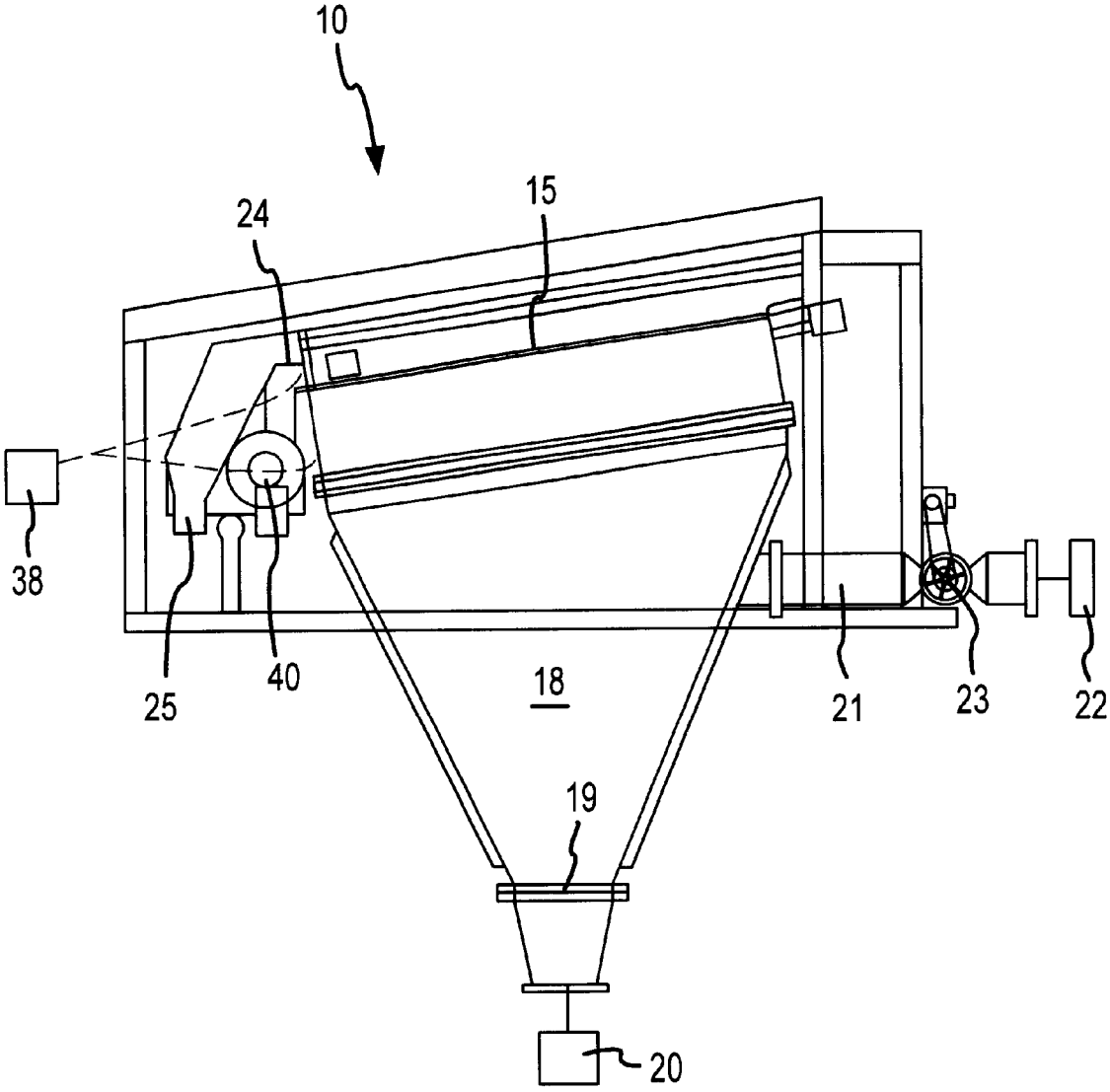
FIG. 5 is another exemplary embodiment of the sifting apparatus having a bucket wheel or star gate discharge.

The embodiment illustrated in FIG. 5 differs from that of FIGS. 1 and 2 in that as a discharge means for the heavier material 16, in addition to the weir 24 that removes the lighter material 17, a bucket wheel or star gate 40 is provided, the speed of which is also controllable by the discharge control device 38.

In the operation of the air sifting apparatus, the material 13 to be handled is fed onto the material bed support device 15 via the feed funnel 11 and the star gate feeder 12, which performs the dosing preparation of the material. Air introduced through the air inlet 19 constantly flows upwardly through the material bed support device 15 from below so as to effect a base fluidization which contributes to a loosening of the material layer lying on the material bed support device 15. The thus loosened material layer exhibits a reduced air resistance than would be exhibited by a material layer on the material bed support device which had not been subjected to a constant air flow. Thereafter, a pulsating air flow is introduced via the air inlet 21 to overlay the constant air flow in the air jig plenum 18, whereby the pulsating air flow is so strongly introduced that it is capable of lifting up the material bed lying on the material bed support device 15. As a result of this sifting movement, the layers of the material bed sort themselves into the relatively heavier material layer 16 and the relatively lighter material layer 17.

To optimize the distribution of gaseous medium, the material bed support device shall cause a pressure drop when measured from the plenum side versus the material bed side that is at least 80% of the pressure drop measured through the material bed.

A separation of the relatively heavier material layer and the relatively lighter material layer is accomplished at the end of the material bed support device 15 by means of the discharge device 24 in the form of a weir, whereby the discharge device 24 is controlled into its appropriate discharge dispositions by a discharge control device 38. The discharge control device receives a signal from a sensor which indicates the position of the border or separation line between the relatively heavier material layer 16 and the relatively lighter material 17. The sensor can be a mechanical or nuclear sensor for sensing the position of the separation line, whereby, in both sensor configurations, the sensors are configured with respect to the differing thickness of the relatively heavier material and the relatively lighter material. In a preferred embodiment of the present invention, the sensor is, however, an optical sensor which, to determine the position of the separation layer, senses the different colors of the coal as the relatively lighter material and the associated partings as the relatively heavier material such that the discharge device 24 can be moved into its appropriate discharge dispositions by the discharge control device 38.

The present invention is, of course, in no way restricted to the specific disclosure of the specification and drawings, but also encompasses any modifications within the scope of the appended claims.

What is claimed is:

1. An air sifting apparatus for preparatory concentration of raw material, comprising:

a material feed-in device;

a material bed support device disposed relative to the material feed-in device for receiving therefrom material to be prepared and having a surface on which the material is supported, the surface having a plurality of openings for passage therethrough of a gaseous medium introduced from underneath the material bed support device, the material bed support device being operable to transport the material along the surface in coordination with the flow of the gaseous medium through the openings into contact with the material so as to effect loosening of the material and stratification of the material into a layer of relatively heavier material on the surface and a layer of relatively lighter material on the layer of relatively heavier material;

an air jig plenum communicated with the underside of the surface of the air sifting apparatus for guiding the gaseous drying medium thereto, the air jig plenum being operable to guide a constant gaseous medium flow constantly through the openings in the surface of the material bed support device into contact with the material on the surface of the material bed support device to promote loosening of the material and the air jig plenum being operable to guide a pulsating gaseous medium flow into contact with the material on the surface of the material bed support device at the same time that the air jig plenum guides the constant gaseous medium flow through the openings in the surface of the material bed support device into contact with the material, whereby the constant gaseous medium flow acts to loosen the material by lifting thereof while the pulsating gaseous medium flow acts contemporaneously during the lifting of the material to promote stratification of the material into a relatively heavier material layer and a relatively lighter material layer with the stratification being accomplished without the segregation into a location exteriorly of the material bed support device of any portion of the material from any other portion of the material; and a discharge control device for controlling the discharge of the material from the material bed support device after the material on the material bed support device has been simultaneously subjected to the continuous gaseous medium flow and the pulsating gaseous medium flow such that, for the first time in the handling of the material by the air sifting apparatus, a segregation into a location exteriorly of the material bed support device of a portion of the material from another portion of the material is effected, the discharge control device operating to direct the relatively lighter material to a relatively lighter material discharge location and to direct the relatively heavier material to another location separate from the relatively lighter material discharge location.

2. An air sifting apparatus according to claim 1 wherein the air sifting apparatus is operable to prepare a preparatory concentration of coal.

3. An air sifting apparatus according to claim 1, wherein the air jig plenum operates with pulsating gaseous medium flow at a pressure which is substantially the same as the pressure of the constant gaseous medium flow.

4. An air sifting apparatus according to claim 1, wherein the air jig plenum is operated to convey the pulsating gaseous medium flow at a pressure which is greater than the pressure of the constant gaseous medium flow.

5. An air sifting apparatus according to claim 1, wherein the air jig plenum is operated to convey the pulsating gaseous medium flow at a flow volume which is less than the flow volume of the constant gaseous medium flow.

6. An air sifting apparatus according to claim 1, wherein the air jig plenum includes a first flow generator for producing the constant gaseous medium flow, and a second flow generator for producing the pulsating gaseous medium flow.

7. An air sifting apparatus according to claim 1, wherein the air jig plenum includes a single flow generator for producing the constant gaseous medium flow and the pulsating gaseous medium flow, and a pressure regulator for adjusting the gaseous medium flows of said flow generator.

8. An air sifting apparatus according to claim 1, wherein the surface of the material bed support device is formed by a plate having holes.

9. An air sifting apparatus according to claim 1, wherein the surface of the material bed support device is formed by a screen.

10. An air sifting apparatus according to claim 8, wherein the material bed support device shall cause a pressure drop, when measured from the plenum side versus the material bed side, that is at least 80% of a pressure drop measured through the material bed.

11. An air sifting apparatus according to claim 9, wherein the material bed support device shall cause a pressure drop, when measured from the plenum side versus the material bed side, that is at least 80% of a pressure drop measured through the material bed.

12. An air sifting apparatus according to claim 1, wherein the material feed-in device is operable to feed material to be prepared to the material bed support device at a substantially uniform feed dosage.

13. An air sifting apparatus according to claim 12, wherein the material feed-in device is a star gate feeder.

14. An air sifting apparatus according to claim 13, wherein the star gate feeder includes a housing, a drive shaft, and a plurality of vanes each having one end rigidedly secured to the drive shaft and an opposite end slidable along an inner wall of the housing as the vanes are rotatably driven by the drive shaft, the vanes being angularly spaced from one another such that adjacent vanes form pockets therebetween for receiving a dose of material to be fed onto the material bed support device, and wherein each vane is formed of a rubber material whose hardness grade or durometer or durometer varies along the height of the vane.

15. An air sifting apparatus according to claim 14, wherein the opposite end of each vane has a relatively lower hardness grade or durometer than the one end of the vane.

16. An air sifting apparatus according to claim 14, wherein each vane is formed over at least 5% of its total length as measured from its opposite end of the rubber material of the relatively lowest hardness grade or durometer.

17. An air sifting apparatus according to claim 14, wherein each vane is formed over at least 25% of its total length as measured from its one end of the rubber material of the relatively highest hardness grade or durometer.

18. An air sifting apparatus according to claim 14, wherein the opposite end of each vane is configured in a ball shape.

19. An air sifting apparatus according to claim 1, wherein the discharge control device includes means for determining the position of the border between the relatively heavier material layer and the relatively lighter material layer.

20. An air sifting apparatus according to claim 19, wherein the layer border determining means is a mechanical sensor for sensing the different thicknesses of the relatively heavier material and the relatively lighter material.

21. An air sifting apparatus according to claim 19, wherein the layerborder determining means is a nuclear sensor for sensing the different densities of the relatively heavier material and the relatively lighter material.

22. An air sifting apparatus according to claim 19, wherein the layer border determining means is an optical sensor for sensing the different colors of the relatively heavier material and the relatively lighter material.

23. An air sifting apparatus according to claim 1, wherein the discharge control device includes a weir, for automatically controlling the discharge of the relatively lighter material, the height of which is adjustably settable as a function of the thickness of the relatively heavier material layer in its role as a sifting bed.

24. An air sifting apparatus according to claim 1, wherein the material feed-in device is a star gate feeder having an adjustable rate of rotation.

25. An air sifting apparatus according to claim 1, and further comprising a housing for enclosing the material bed support device in a manner which prevents the outward movement of dust.

26. An air sifting apparatus according to claim 25, wherein the housing for enclosing the material bed support device is secured to the material bed support device via a seal.

* * * * *